United States Patent [19]

Toya

[11] Patent Number: 5,001,044

[45] Date of Patent: Mar. 19, 1991

[54] SILVER HALIDE PHOTOGRAPHIC ELEMENT

[75] Inventor: Ichizo Toya, Kanagawa, Japan

[73] Assignee: Fuji Photo Film Co., Tokyo, Japan

[21] Appl. No.: 569,488

[22] Filed: Aug. 17, 1990

Related U.S. Application Data

[63] Continuation of Ser. No. 239,821, Sep. 2, 1988, abandoned.

[30] Foreign Application Priority Data

Sep. 4, 1987 [JP] Japan ..... 62-221284

[51] Int. Cl.[5] ..... G03C 1/76

[52] U.S. Cl. ..... 430/523; 430/337; 430/518; 430/536; 430/539

[58] Field of Search ..... 430/518, 523, 539, 536, 430/337

[56] References Cited

U.S. PATENT DOCUMENTS

| | | | |
|---|---|---|---|
| 3,726,683 | 4/1973 | Yamamoto et al. | 430/518 |
| 3,740,228 | 6/1973 | Ohlschlager et al. | 430/518 |
| 3,758,445 | 9/1973 | Cohen et al. | 430/518 |
| 3,788,855 | 1/1974 | Cohen et al. | 430/518 |
| 3,948,663 | 4/1976 | Shiba et al. | 430/518 |
| 4,312,940 | 1/1982 | Nakamura et al. | 430/518 |
| 4,323,644 | 4/1982 | Nakamura et al. | 430/518 |
| 4,353,972 | 10/1982 | Helling et al. | 430/518 |
| 4,379,838 | 4/1983 | Helling et al. | 430/518 |
| 4,500,631 | 2/1985 | Sakamoto et al. | 430/518 |
| 4,721,666 | 1/1988 | Yamanouchi et al. | 430/518 |

*Primary Examiner*—Jack P. Brammer

*Attorney, Agent, or Firm*—Sughrue, Mion, Zinn, Macpeak & Seas

[57] ABSTRACT

A silver halide photographic material which comprises a support having provided thereon at least one silver halide emulsion layer and at least one layer comprising a polymer containing a group which can be dissociated to form a cation in a fixer, wherein a layer containing substantially no silver halide grains is provided between the layer comprising the polymer and the silver halide emulsion layer. The photographic material exhibits a high fixing speed and is substantially free from surface defects such as streaking and acne.

15 Claims, No Drawings

SILVER HALIDE PHOTOGRAPHIC ELEMENT

This is a continuation of application Ser. No. 07/239,821 filed Sept. 2, 1988, now abandoned.

FIELD OF THE INVENTION

This invention relates to a silver halide photographic material comprising a polymer containing a group which can be dissociated to form a cation in a fixer, and more particularly relates to a photographic material free from surface defects, such as acne and streaking.

BACKGROUND OF THE INVENTION

It was previously discovered that fixation can be accelerated by providing a layer comprising a polymer containing a group which can be dissociated to form a cation in a fixer in a photographic light-sensitive material as disclosed in Japanese Patent Application No. 61-247111. As a result of further studies, however, it has been proved that surface defects, such as acne and streaking eventually occur when a layer containing silver halide is coated directly onto a layer comprising the polymer containing a group which can be dissociated-to form a cation in a fixer.

SUMMARY OF THE INVENTION

One object of this invention is to provide a silver halide photographic material which exhibits a high fixing speed without suffering from surface defects even when coating is carried out over a long period of time.

It has now been found that the above object can be accomplished by providing a silver halide photographic material which comprises a support having provided thereon at least one silver halide emulsion layer and at least one layer comprising a polymer containing a group which can be dissociated to form a cation in a fixer (hereinafter "cationic polymer"), wherein a layer containing substantially no silver halide grains is provided between the cationic polymer-containing layer and the silver halide emulsion layer.

DETAILED DESCRIPTION OF THE INVENTION

The silver halide photographic material according to the present invention comprises a support having provided thereon at least one layer containing a cationic polymer as described in Japanese Patent Application No. 61-247111. The crux of the present invention lies in that a layer containing substantially no silver halide grains is provided between the cationic polymer layer and a layer containing silver halide grains.

The layer containing substantially no silver halide grains preferably comprises a high-molecular weight gelatin as disclosed in JP-A-62-87952 (the term "JP-A" as used herein means an "unexamined published Japanese patent application"). Such a high-molecular weight gelatin is gelatin containing at least 12%, preferably at least 14% by weight of a high-molecular weight component which is defined in JP-A-62-87952.

The layer containing substantially no silver halide grains which is provided between layers preferably has a film thickness of 1 μm or less, more preferably 0.6 μm or less. This layer can contain any kind of additives hereinafter described, but the use of high-molecular weight compounds having an anionic group should be avoided.

The cationic polymer in a fixer used in the present invention preferably includes anion exchange polymers, such as various kinds of ammonium or phosphonium salt polymers widely known as mordant polymers or antistatic polymers. Examples of these polymers include aqueous dispersion latices described in JP-A-59-166940, U.S. Pat. No. 3,958,995, and JP-A-142339, JP-A-54-126027, JP-A-54-155835, JP-A-53-30328, and JP-A-54-92274; polyvinyl pyridinium salts described in U.S. Pat. Nos. 2,548,564, 3,148,061, and 3,756,814; water-soluble ammonium salt polymers described in U.S. Pat. No. 3,709,690; and water-insoluble ammonium salt polymers described in U.S. Pat. No. 3,898,088.

Of these anion exchange polymers, preferred are those represented by formula (I):

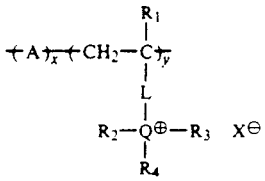

(I)

wherein A represents an ethylenically unsaturated monomer unit; $R_1$ represents a hydrogen atom or a lower alkyl group having from 1 to about 6 carbon atoms; L represents a divalent group containing from 1 to about 12 carbon atoms; $R_2$, $R_3$, and $R_4$, which may be the same or different, each represents an alkyl group having from 1 to about 20 carbon atoms, an aralkyl group having from 7 to about 20 carbon atoms, or a hydrogen atom; or $R_2$, $R_3$, and $R_4$ are connected to each other to form a cyclic structure together with Q; Q represents N or P; $X^{\ominus}$ represents an anion other than an iodine ion; x represents a copolymerization ratio ranging from 0 mol % to about 90 mol %; and y represents a copolymerization ratio ranging from about 10 mol % to 100 mol %.

Monomers providing the unit represented by A include olefins (e.g., ethylene, propylene, 1-butene, vinyl chloride, vinylidene chloride, isobutene, and vinyl bromide), dienes (e.g., butadiene, isoprene, and chloroprene), ethylenically unsaturated esters of aliphatic or aromatic carboxylic acids (e.g., vinyl acetate, allyl acetate, vinyl propionate, vinyl butyrate, and vinyl benzoate), esters of ethylenically unsaturated acids (e.g., methyl methacrylate, butyl methacrylate, t-butyl methacrylate, cyclohexyl methacrylate, benzyl methacrylate, phenyl methacrylate, octyl methacrylate, amyl acrylate, 2-ethylhexyl acrylate, benzyl acrylate, dibutyl maleate, dietyl fumarate, etyl crotonate, and dibutyl methylenemalonate), styrenes (e.g., styrene, α-methylstyrene, vinyltoluene, chloromethylstyrene, chlorostyrene, dichlorostyrene, and bromostyrene), and unsaturated nitriles (e.g., acrylonitrile, methacrylonitrile, allyl cyanide, and crotononitrile). From the standpoint of emulsion polymerizability and hydrophobic properties, preferred among them are styrenes and methacrylic esters. These monomers may be used either individually or in combinations of two or more thereof; that is, the monomer unit A may contain two or more units derived from the above described monomers.

$R_1$ preferably represents a hydrogen atom or a methyl group from the standpoint of polymerization reactivity.

Only one of $R_2$, $R_3$, and $R_4$ preferably represents a hydrogen atom from the viewpoint of color residue.

L preferably represents

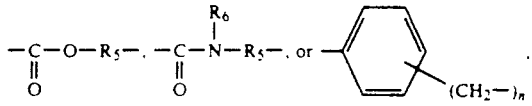

wherein $R_5$ represents an alkylene group (e.g., methylene, ethylene, trimethylene, and tetramethylene), an arylene group, or an aralkylene group

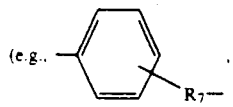

wherein $R_7$ represents an alkylene alkylene group having up to about 6 carbon atoms); $R_6$ represents a hydrogen atom or $R_2$; and n represents 1 or 2.

From the standpoint of alkali resistance, more preferred is

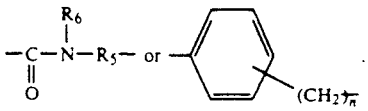

From the viewpoint of emulsion polymerizability, the most preferred is

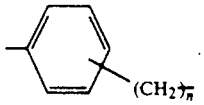

Q preferably represents N from the standpoint of harmlessness of the starting materials.

$X^{\ominus}$ represents an anion other than an iodine ion and includes, for example, a halogen ion (e.g., chlorine and bromine ions), an alkylsulfate ion (e.g., methylsulfate and ethylsulfate ions), an alkyl or arylsulfonate ion (e.g., methanesulfonate, ethanesulfonate, benzenesulfonate, and p-toluenesulfonate ions), a nitrate ion, an acetate ion, a sulfate ion, etc. Particularly preferred among them are chlorine, alkylsulfate, arylsulfonate and sulfate ions.

Included in the alkyl group and aralkyl group as represented by $R_2$, $R_3$, and $R_4$ are substituted or unsubstituted alkyl groups and substituted or unsubstituted aralkyl groups. The alkyl group includes an unsubstituted alkyl group (e.g., methyl, ethyl, propyl, isopropyl, t-butyl, hexyl, cyclohxyl, 2-ethylhexyl, and dodecyol) and a substituted alkyl group, such as an alkoxyalkyl group (e.g., methyoxymethyl, methoxybutyl, ethoxyethyl, butoxyethyl, and vinyloxyethyl), a cyanoalkyl group (e.g., 2-cyanoethyl and 3-cyanopropyl), a halogenated alkyl group (e.g., 2-fluoroethyl, 2-chloroethyl, and perfluoropropyl), an alkoxycarbonylalkyl group (e.g., ethoxy-carobonylmethyl), an allyl group, a 2-butenyl group, a propargyl group, etc. The aralkyl group includes an unsubstituted aralkyl group (e.g., benzyl, phenethyl, diphenylmethyl, and naphthylmethyl) and a substituted aralkyl group, such as an alkylaralkyl group (e.g., 4-methylbenzyl, 2,5-dimethylbenzyl, 4-isopropylbenzyl, and 4-octylbenzyl), an alkoxyaralkyl group (e.g., 4-methoxybenzyl, 4-pentafluoropropenyloxybenzyl, and 4-ethoxybenzyl), a cyanoaralkyl group [e.g., 4-cyanobenzyl and 4-(4-cyanophenyl)benzyl], a halogenated aralkyl group [e.g., 4-chlorobenzyl, 3-chlorobenzyl, 4-bromobenzyl, and 4-(4-chlorophenyl)benzyl], etc.

The alkyl group preferably contains from 1 to 12 carbon atoms, and the aralkyl group preferably contains from 7 to 14 carbon atoms.

The cyclic structure formed by $R_2$, $R_3$, $R_4$, and Q includes heterocyclic rings represented by formula:

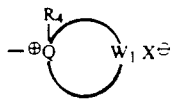

wherein $R_4$, Q, and X- are as defined above; and $W_1$ represents an atomic group necessary to form an aliphatic heterocyclic group together with Q.

Examples of the heterocyclic ring are:

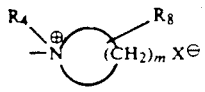

wherein $R_4$ and X- are as defined above; $R_8$ represents a hydrogen atom or $R_4$; and m represents an integer of from 2 to 12;

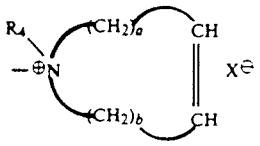

wherein $R_4$ and X- is as defined above; and a and b each represents an integer selected so that they total 2 to 7;

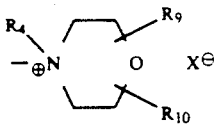

wherein $R_4$ and X- are as defined above; $R_9$ and $R_{10}$, which may be the same or different, each represents a hydrogen atom or a lower alkyl group having from 1 to 6 carbon atoms; and

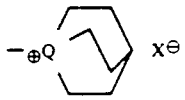

wherein Q and X- are as defined above.

Additional examples of the cyclic structure formed by $R_2$, $R_3$, $R_4$, and Q are:

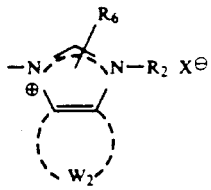

wherein $R_2$, $R_6$, and X- are as defined above; and W2 represents nil or an atomic group necessary to form a benzene ring;

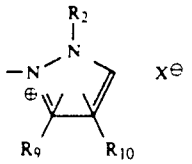

wherein $R_2$, $R_9$, $R_{10}$, and X- are as defined above, and

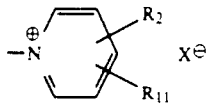

wherein $R_2$ and X- are as defined above: and $R_{11}$ represents a hydrogen atom,

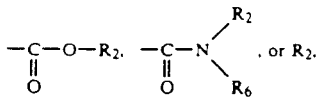

wherein $R_2$ and $R_6$ are as defined above; two $R_2$ groups may be the same or different.

Among these cyclic structures, preferred are

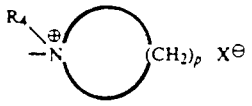

wherein $R_4$ and $X^-$ are as defined above; and p represents an integer of from 4 to 6; and

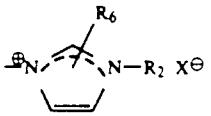

wherein $R_2$, $R_6$ and $X^-$ are as defined above.

In formula (I), the monomer unit on the right hand side (y component) may be a single unit or a mixed unit composed of two or more kinds of monomer units.

x is preferably from 20 to 60 mol %; and y is preferably from 40 to 80 mol %.

In order to prevent the cationic polymer from migrating to other layers or into a processing solution to exert photographically unfavorable influences, it is preferable to copolymerize a monomer having at least two, preferably 2 to 4, ethylenically unsaturated groups to form a crosslinked aqueous polymer latex.

Such a crosslinked aqueous polymer latex preferably has a structure represented by formula (II):

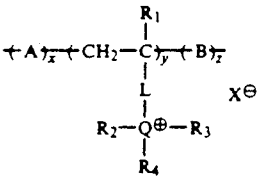

(II)

wherein A, $R_1$, $R_2$, $R_3$, $R_4$, L, Q, and $X^-$ are as defined above; x represents a copolymerization ratio of from 0 to 80 mol %, preferably from 0 to 40 mol %; y represents a copolymerization ratio of from 10 to 99.9 mol %, preferably from 10 to 95 mol %; z represents a copolymerization ratio of from 0.1 to 50 mol %, preferably from 1 to 20 mol %; B represents monomer unit derived from a copolymerizable monomer having at least two ethylenically unsaturated groups.

Specific examples of monomers representing the monomer unit represented by B are ethylene glycol dimethacrylate, diethylene glycol dimethacrylate, neopentyl glycol dimethacrylate, tetramethylene glycol dimethacrylate, pentaerythritol tetramethyacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylylene-diammonium dichloride, N,N'-bis(vinylbenzyl)-triethylenediammonium dichloride, N,N,-N',N'-tetrabutyl-N,N'-bis-(vinylbenzyl)-ethylenediammonium dichloride, and the like. Preferred of them are units derived from divinylbenzene and trivinylcyclohexane in view of their hydrophobic properties and alkali resistance.

Specific but non-limitative examples of the action exchange polymers represented by formula (III)-(IX) are shown below.

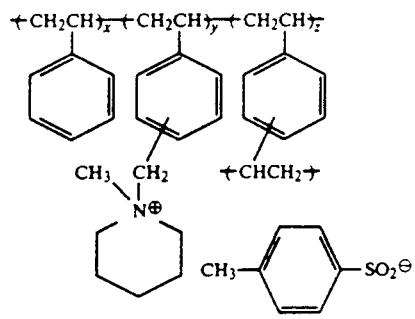

(III)

x:y:z = 47.5:47.5:5

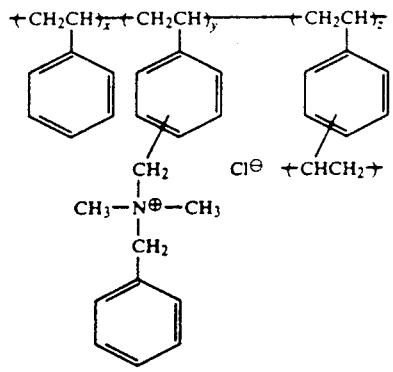

(IV)

x:y:z = 45:45:10

-continued (V)

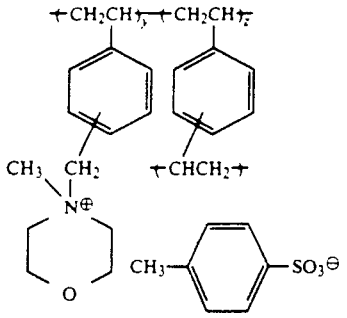

y:z = 95:5

(VI)

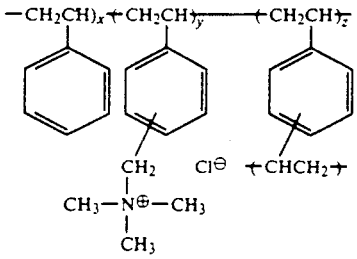

x:y:z = 45:45:10

(VII)

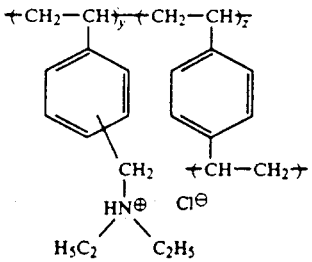

y:z = 90:10

(VIII)

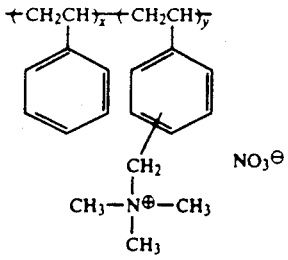

x:y = 50:50

(IX)

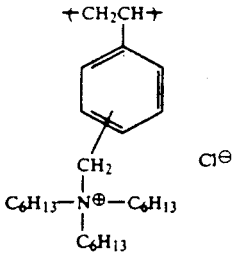

Further included among the cationic polymer which can be used in the present invention are polymers containing a residual group formed by the reaction between a ketone and a aminoguanidine derivative as described in JP-A-47-13935, JP-B-49-15820 (the term "JP-B" as used herein means an "examined published Japanese patent publication"), and U.S. Pat. Nos. 2,882,156 and 3,740,228. Specific examples of such polymers are shown below as represented by formulas (1)-(25).

(1)

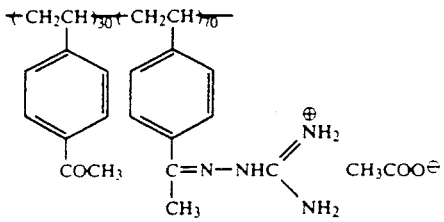

(2)

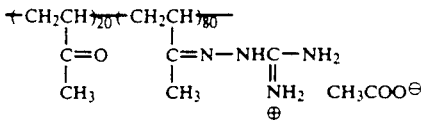

(3)

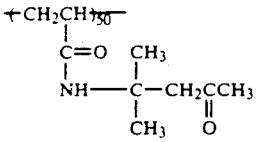

(4)

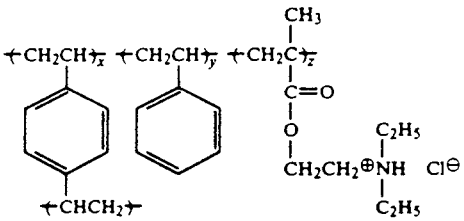

x:y:z: = 15:5:80

(5)

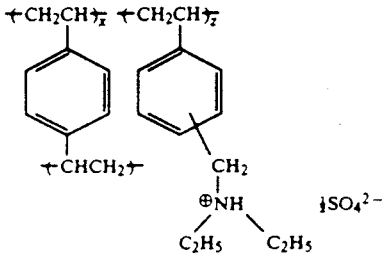

x:z = 25:75

(6)

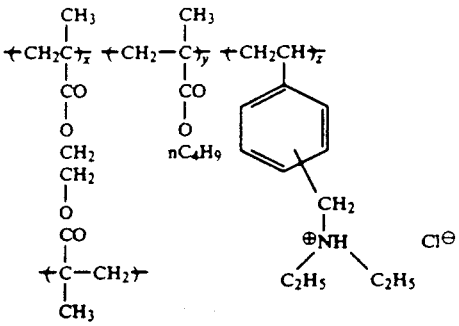

x:y:z = 30:35:35

-continued
(7)
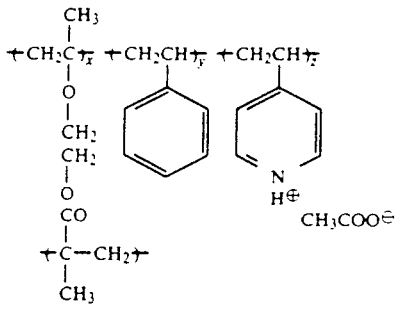
x:y:z = 40:10:50
(8)
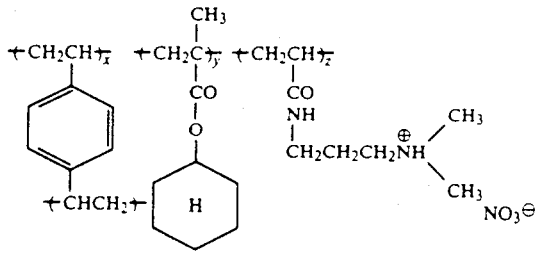
x:y:z = 25:15:60
(9)
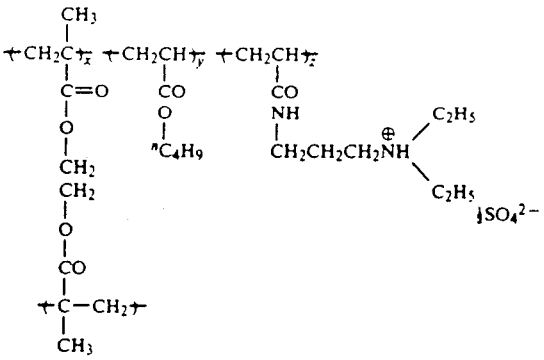
x:y:z = 25:15:60
(10)
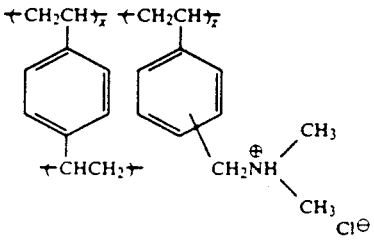
x:z = 20:80
(11)
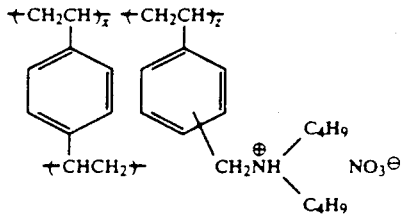
x:z = 30:70
-continued
(12)
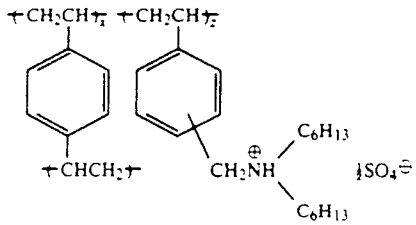
x:z = 30:70
(13)
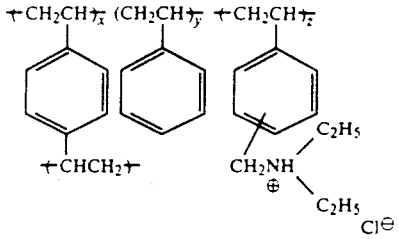
x:y:z = 15:30:55
(14)
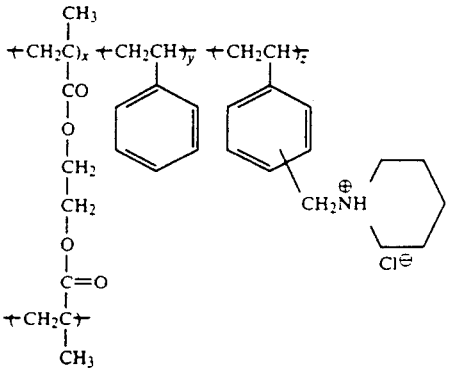
x:y:z = 40:10:50
(15)
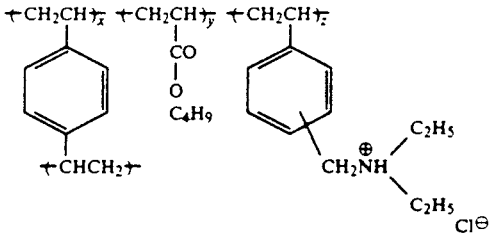
x:y:z = 50:10:40
(16)
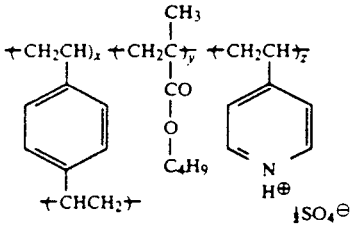
x:y:z = 20:10:70
(17)
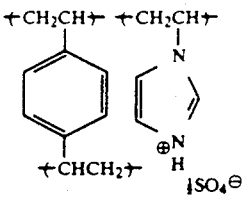
x:z = 50:50

-continued (18)

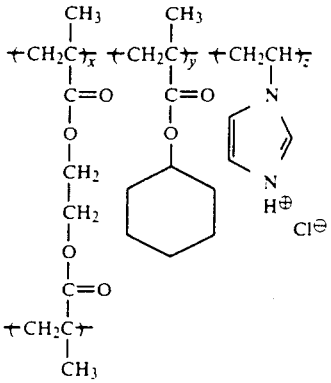

x:y:z = 25:25:50

(19)

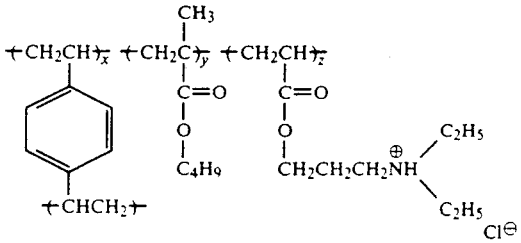

x:y:z = 15:15:70

(20)

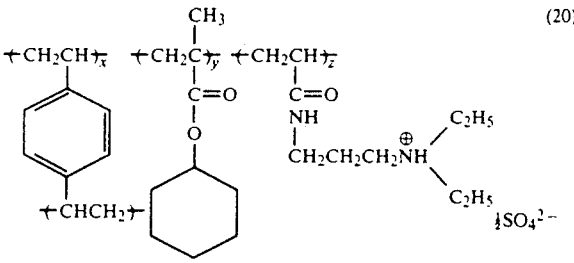

x:y:z = 35:5:60

(21)

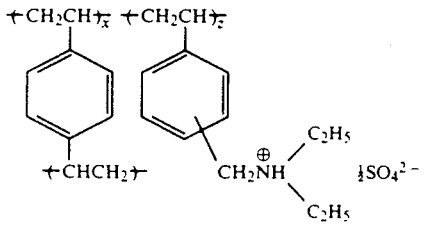

x:z = 50:50

(22)

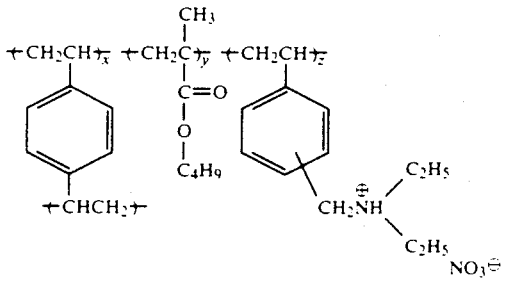

x:y:z = 45:5:50

-continued (23)

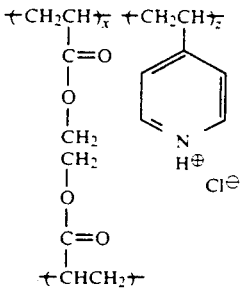

x:z = 15:85

(24)

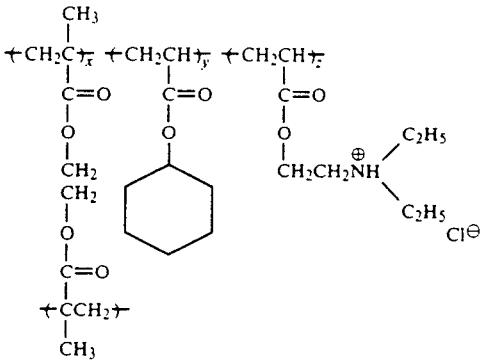

x:y:z = 20:10:70

(25)

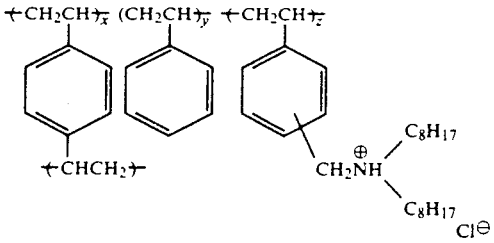

x:y:z = 17.5:2.5:80

The cationic polymer is generally added to the light-sensitive material, in an amount of 0.1 or more, preferably from 0.3 to 100, more preferably from 0.5 to 30, in terms of the group which can be dissociated to form a cation in a fixer, per mol of the total iodine content of the light-sensitive material.

The cationic polymer may be added to either a light-sensitive layer or a light-insensitive layer, and is preferably added to a light-insensitive layer provided between alight-sensitive layer and a support. Of the cationic polymers used in the present invention, those having great iodine ion-trapping ability are preferred.

Silver halide grains in the photographic emulsion may have any crystal form, such as regular form (e.g., cubic, octahedral, rhombic dodecahedral and tetradecahedral forms), an irregular form (e.g., spherical and plate-like forms), and a composite form thereof. Tabular grains having an aspect ratio of 5 or more as described in *Research Disclosure*, Vol. 225, pp. 20–58 (January, 1983) may also be used.

Further, the silver halide grains may have an epitaxial structure or may have a layered structure composed of an outer shell and a core having different compositions (e.g., a halogen composition).

Silver halide grains preferably have a mean grain size of not smaller than 0.5 μm, more preferably of from 0.7 to 5.0 μm.

The grain size distribution may be either broad or narrow. Emulsions having a narrow grain size distribution are known as monodispersed emulsions and those having a coefficient of variation (a quotient obtained by dividing a standard deviation by a mean grain size, expressed in percentage) of 20% or less, preferably 15% or less, are suitable.

Silver halide emulsions to be used in the present invention can be prepared by known techniques as described, e.g., in P. Galfkides, *Chimie et Physique Photographique*, Paul Montel (1967), G. F. Duffin, *Photographic Emulsion Chemistry*, The Focal Press (1966), and V. L. Zelikman, et al., *Making and Coating Photographic Emulsion*, The Focal Press (1964). In some detail, the silver halide emulsions can be prepared by any of the acid process, the neutral process, the ammonia process, and the like. The reaction between a soluble silver salt and a soluble halogen salt can be carried out by any of a single jet method, a double jet method, a combination thereof, and the like.

Examples of the silver halide include silver chloride, silver bromide, silver iodide, and mixed silver halides, e.g., silver iodobrimide, silver chloroiodobromide, and silver chloroiodide. The iodine content of the photographic emulsions generally average 3 mol % or more, preferably 6 mol % or more, and more preferably from 8 to 40 mol %. The silver coverage of the light-sensitive material preferably ranges from 1 to 20 g/m$^2$, more preferably from 2 to 10 g/m$^2$. The total iodine content (AgI) in the silver halide light-sensitive material is preferably not less than $4\times10^{-3}$ mol/m$^2$, more preferably from $6\times10^{-3}$ to $4\times20^{-2}$ mol/m$^2$.

During the formation of silver halide grains of subsequent physical ripening, a cadmium salt, a zinc salt, a lead salt, a thallium salt, an iridium salt or a complex salt thereof, a rhodium salt or a complex salt thereof, an iron salt or a complex salt thereof, etc. may be present in the system.

Binders which can be used in emulsion layers or other layers include proteins such as gelatin, casein, etc.; cellulose derivatives, e.g., hydroxyethyl cellulose, carboxymethyl cellulose, etc.; sugar derivatives, e.g., agar, sodium alginate, dextran, starch derivatives, etc.; and a variety of synthetic hydrophilic colloids such as polyvinyl alcohol, ply-N-vinylpyrrolidone, polyacrylic acid copolymers, polyacrylamide, and deivatives or partial hydrolysis products thereof.

Gelatin to be used includes lime-processed gelatin, acid-processed gelatin, and enzyme-processed gelatin The photographic layers of the light-sensitive material of the present invention can contain an alkyl acrylate latex as described, e.g., in U.S. Pat. Nos. 3,411,911 and 3,411,912 and JP-B-45-5331.

The silver halide emulsion to be used is preferably subjected to chemical sensitization. Chemical sensitization can be carried out by the processes described in the above-described reference to Glafkides or Zelikman, et al., or H. Frieser (ed.), *Die Grundlagen der Photographischen Prozesse mit Silberhalogeniden*, Akademische Verlagsgesellschaft (1968). In more detail, chemical sensitization can be carried out by sulfur sensitization using active gelatin or a sulfur-containing compound capable of reacting with silver, e.g., thiosulfantes, thioureas, thiazoles, and rhodanines; reduction sensitization using a reducing substance, e.g., stannous salts, amines, hydrazine derivatives, formamidinesulfinic acid, and silane compounds; nobel metal sensitization using a noble metal compound, e.g., gold complex salts as well as complex salts of group VIII metals, e.g., platinum, iridium, and palladium; and combinations thereof.

The light-sensitive materials of the present invention can contain various compounds known as stabilizers, such as azoles, e.g., benzothiazolium salts, nitroindazoles, triazoles, benzotriazoles, and benzimidazoles (especially nitro- or halogen substitutes); heterocyclic mercapto compounds, e.g., mercaptothiazoles, mercaptobenzothiazoles, mercaptobenzimidazoles, mercaptothiadiazoles, mercaptotetrazoles (especially 1-phenyl-5-mercaptotetrazole), and mercapto-pyrimidines; these heterocyclic mercapto compounds having a water-soluble group, e.g., a carboxyl group and a sulfo group; thioketo compounds, e.g., oxazolinethione; azaindenes, e.g., tetraazaindenes, especially 4-hydroxy-substituted (1,3,3a,7)-tetraazaindenes; benzene-thiosulfonic acids; benzenesulfinic acid; and the like The photographic emulsion layers or other hydrophilic colloid layers of the photographic material may further contain a surface active agent for various purposes, for example, as a coating aid or an antistatic agent or from improvement of sliding properties, improvement of emulsifying dispersibility, prevention of adhesion, improvement of photographic characteristics (e.g., acceleration of development, increase of contrast, and increase of sensitivity).

Example of the surface active agent to be added include nonionic surface active agents such as saponin (steroid type), alkylene oxide derivatives (e.g., polyethylene glycol, polyethylene glycol/polypropylene glycol condensation products, polyethylene glycol alkyl ethers or alkylaryl ethers, polyethylene glycol esters, polyethylene glycol sorbitan esters, polyalkylene glycol alkylamines or amides, and silicon-polyethylene oxide adducts), glycidol derivatives (e.g., alkenylsuccinic polyglycerides, and alkylphenyl polyglycerides), fatty acid esters of polyhydric alcohols, and alkyl esters of sugars; anionic surface active agents containing an acid group (e.g., carboxyl, sulfo, phospho, sulfate, and phosphate groups) such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkylphenyl ethers, polyoxyethylene alkylphosphates, etc.; amphoteric surface active agents such as amino acids, aminoalkylsulfonic acids, aminoalkyl sulfates or phosphates, alkylbetaines, amine oxides, etc.; and cationic surface active agents such as alkylamine salts, aliphatic or aromatic quaternary ammonium salts, heterocyclic quaternary ammonium salts, e.g., pyridinium and imidazolium, aliphatic or heterocyclic phosphonium or sulfonium salts, and so on. In particular, polyoxyethylene type surface active agents and fluorine-containing surface active agents are preferred.

The polyoxyethylene surface active agent to be used preferably contains at least two, more preferably from 2 to 100, oxyethylene groups. Preferred polyoxyethylene surface active agents are those represented by formulae (X-a), (X-b), and (X-c) shown below.

$$R^{101}-A-(CH_2CH_2O)_{n1}-R^{102} \qquad \text{(X-a)}$$

-continued (X-b)

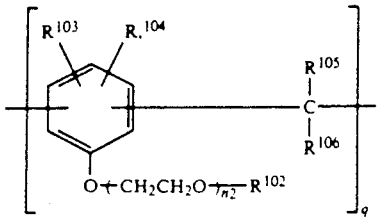

(X-c)

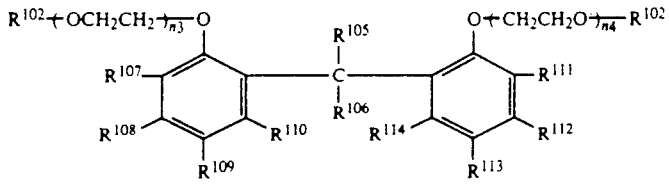

wherein $R^{101}$ represents a hydrogen atom or a substituted or unsubstituted alkyl, alkenyl or aryl group having up to 30 carbon atoms; A represents -O-, -S-, -COO-, $$-\overset{|}{N}-R^{115},\quad -CO-\underset{|}{N}-R^{115}\quad \text{or}\quad -SO_2\underset{|}{N}-R^{115},$$

wherein $R^{115}$ represents a hydrogen atom or a substituted or unSubstituted alkyl group; $R^{102}$ has the same meaning as $R^{101}$ or $R^{101}$-A-; $R^{103}$, $R^{104}$, $R^{108}$, $R^{110}$, $R^{112}$, and $R^{114}$ Which may be the same or different, each represents a hydrogen atom, a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unSubstituted sulfamoyl group; $R^{107}$, $R^{109}$, $R^{111}$, and $R^{113}$, Which may be the same or different, each represents a substituted or unsubstituted alkyl group, a substituted or unsubstituted aryl group, a substituted or unsubstituted alkoxy group, a halogen atom, a substituted or unsubstituted acyl group, a substituted or unsubstituted amido group, a substituted or unsubstituted sulfonamido group, a substituted or unsubstituted carbamoyl group or a substituted or unsubstituted sulfamoyl group; $R^{105}$ and $R^{106}$ which may be the same or different, each represents a hydrogen atom, a substituted or unsubstituted alkyl group, a substituted or unsubstituted aryl group or a substituted or unsubstituted heterocyclic aromatic ring; further provided that a pair of $R^{105}$ and $R^{106}$, $R^{107}$ and $R^{108}$, $R^{109}$ and $R^{110}$, $R^{111}$ and $R^{112}$, or $R^{113}$ and $R^{114}$ may together with the adjacent atoms form a substituted or unsubstituted ring; $n_1$, $n_2$, $n_3$, and $n_4$, which may be the same or different, each represents an average degree of polymerization of the ethylene oxide unit ranging from 2 to 100; and q represents an average degree of polymerization ranging from 5 to 50.

Specific examples of the above-described polyoxyethylene compounds are shown below.

$C_{11}H_{23}COO(CH_2CH_2O)_8H$ III-1

$C_{15}H_{31}COO(CH_2CH_2O)_{15}H$ III-2

-continued $C_{17}H_{33}COO(CH_2CH_2O)_{15}CH_3$ III-3

$C_{18}H_{35}O(CH_2CH_2O)_{20}H$ III-4

$C_{12}H_{25}O(CH_2CH_2O)_{10}H$ III-5

$C_{16}H_{33}O(CH_2CH_2O)_{23}H$ III-6

III-7

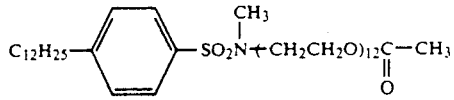

$C_{22}H_{45}O(CH_2CH_2O)_{25}H$ III-8

III-9

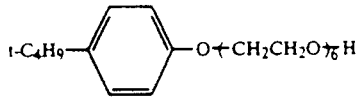

III-10

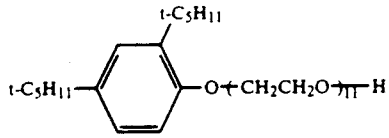

III-11

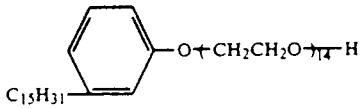

III-12

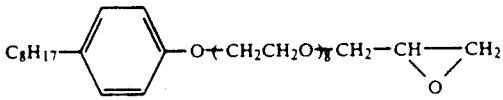

III-13

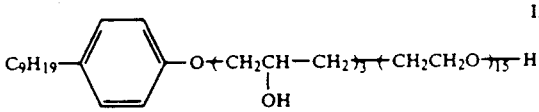

III-14

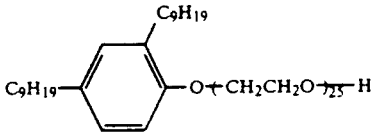

-continued

III-15

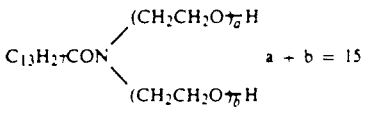

a + b = 15

The amount of these polyoxyethylene surface active agents to be used varies depending on the type or structure of the photographic material, the coating method, and the like. In general, it is 6.0 mg or more, preferably 60 mg or more, per mol of silver in the lightsensitive material.

The polyoxyethylene surface active agent is preferably added to a light-sensitive emulsion layer but may also be added to a light-insensitive layer.

The light-sensitive material of the present invention can contain a dye having an absorption in the visible light region. It is preferable that 80% or more of the total dye is incorporated into a layer nearer to a support than to the light-sensitive layer.

Specific but non-limitative examples of such a dye are shown below.

Dye-1

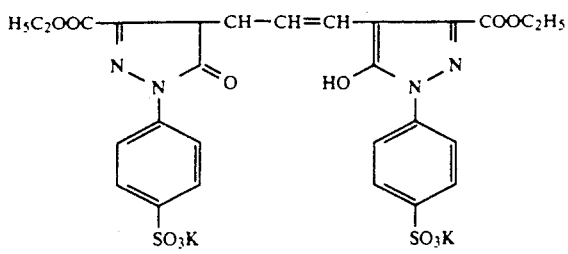

Dye-2

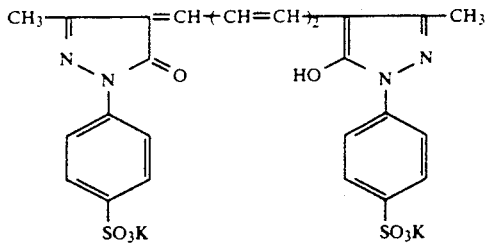

Dye-3

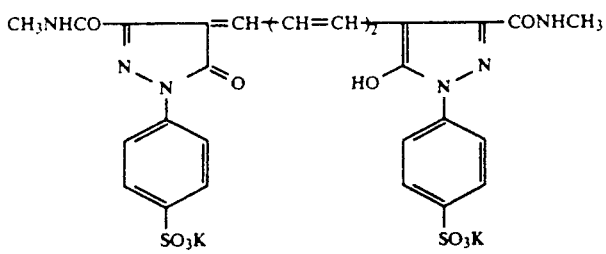

Dye-4

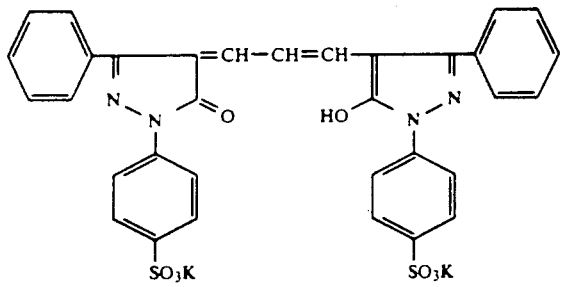

Dye-5

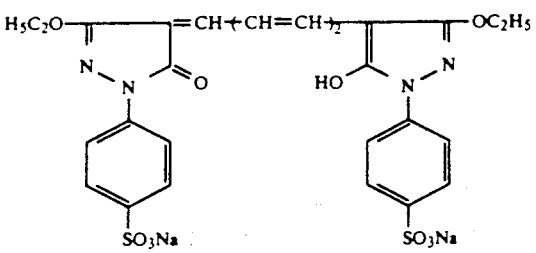

-continued
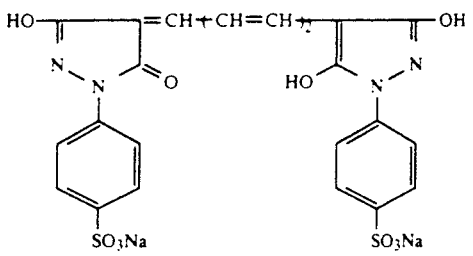
Dye-6
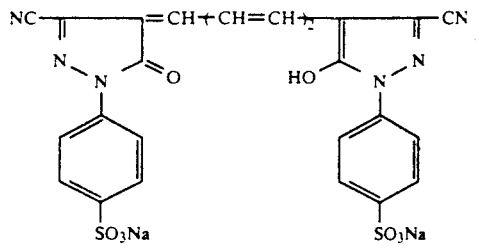
Dye-7
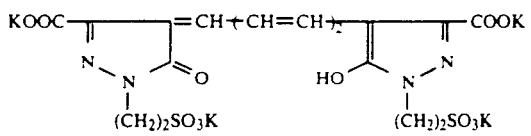
Dye-8
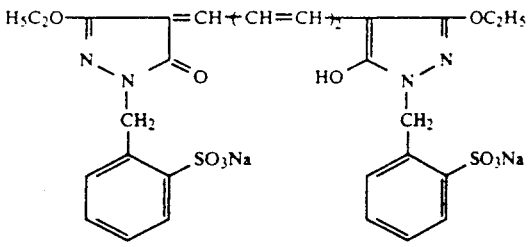
Dye-9
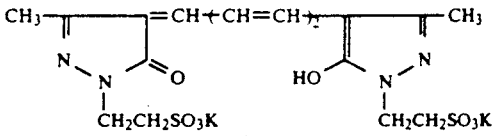
Dye-10
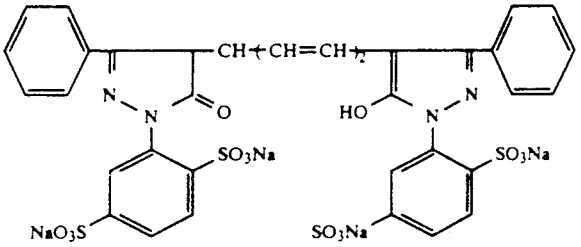
Dye-11
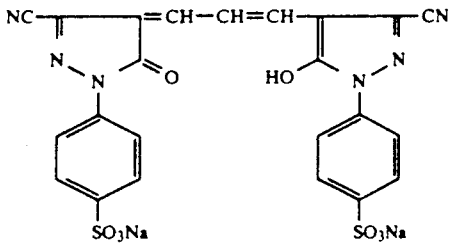
Dye-12

-continued
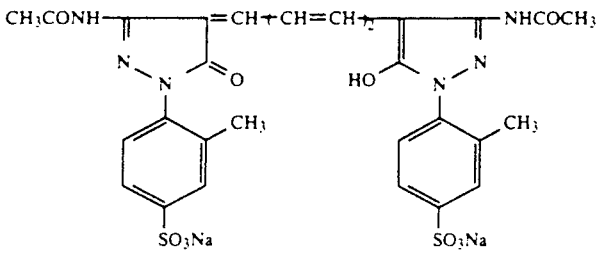
Dye-13
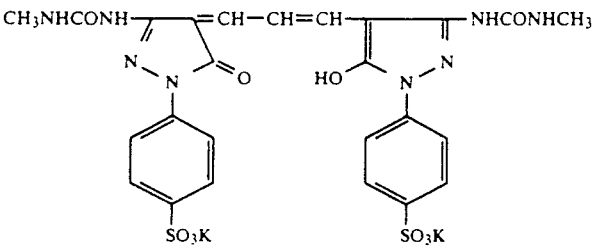
Dye-14
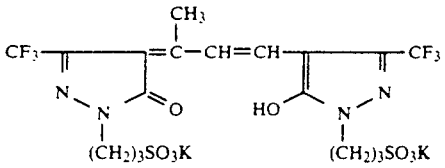
Dye-15
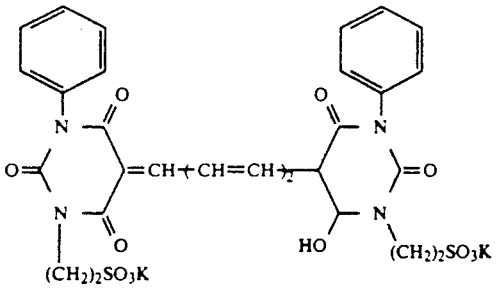
Dye-16
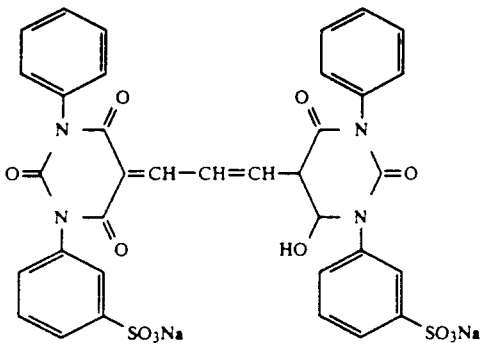
Dye-17
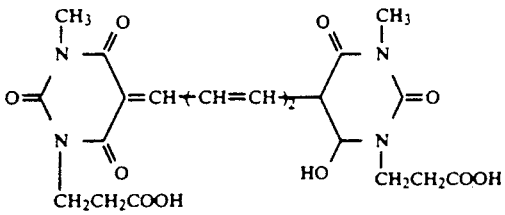
Dye-18

-continued
Dye-19
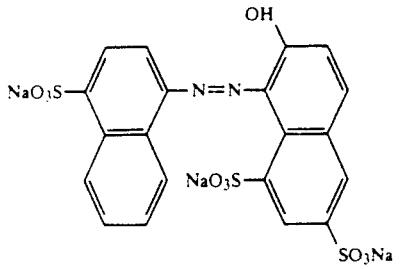
Dye-20
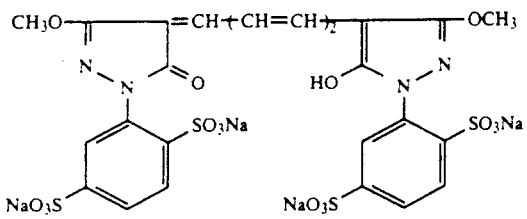
Dye-21
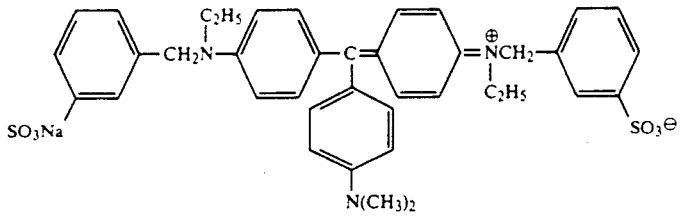
Dye-22
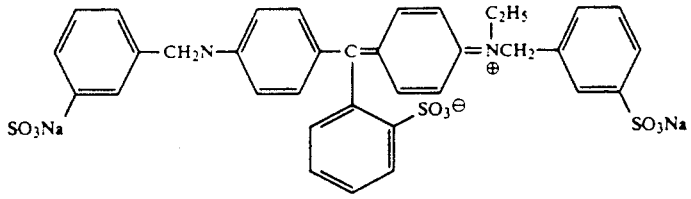
Dye-23
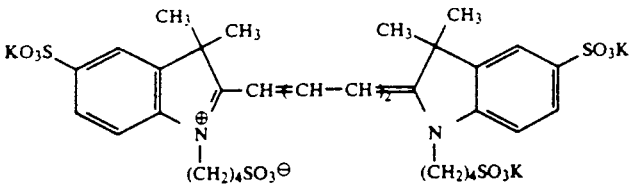
Dye-24
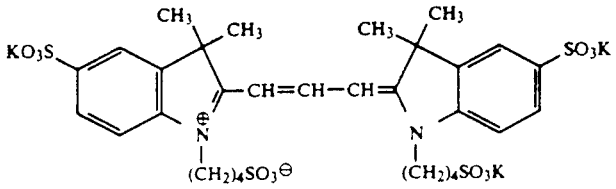
Dye-25
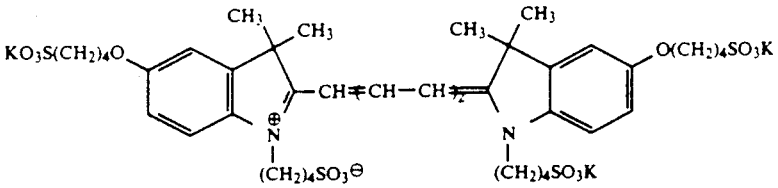
Dye-26
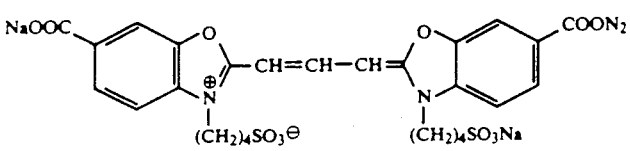

-continued
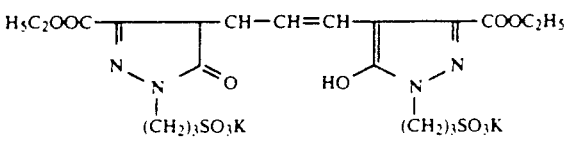
Dye-27
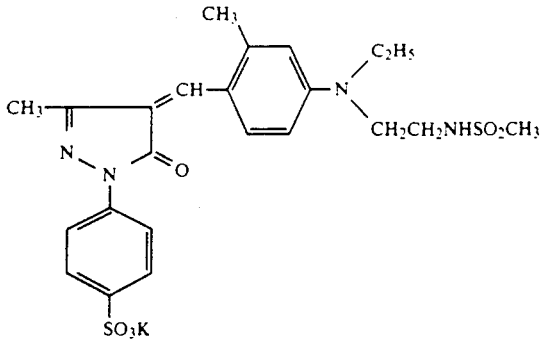
Dye-28
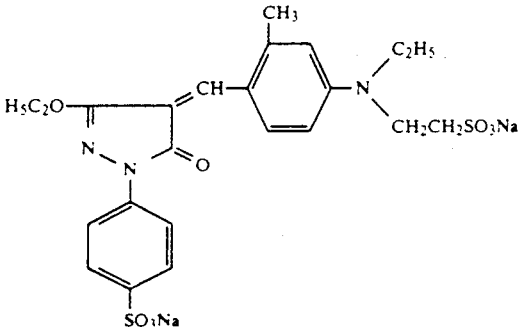
Dye-29
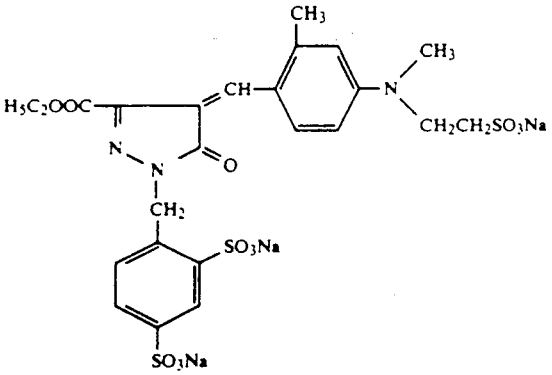
Dye-30
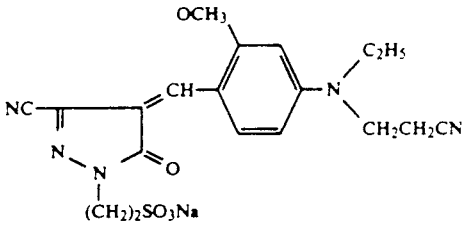
Dye-31
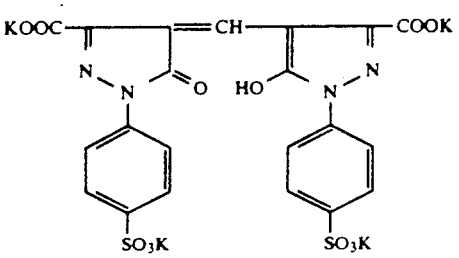
Dye-32

-continued

Dye-33

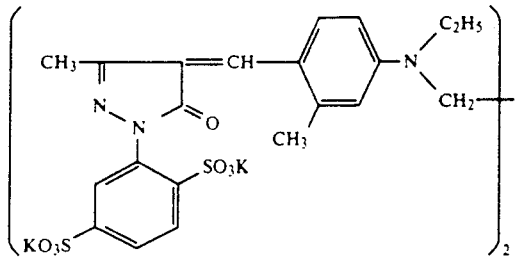

Dye-34

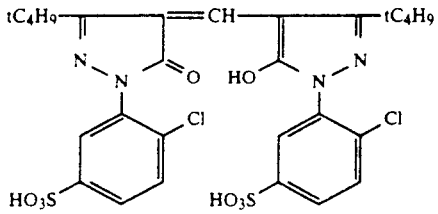

Coating compositions for preparing the lightsensitive material can contain compounds for increasing the viscosity, such as those described in JP-B-59-7724 and JP-B-57-053933, Japanese Patent Application No. 61-61208, and U.S. Pat. No. 3,022,172. In particular, water-soluble polymers, e.g., polystyrenesulfonic acid and poly-3,3-acrylamide-methylpropanesulfonic acid, are preferred.

The photographic emulsion layer or the lightinsensitive hydrophilic colloid layer of the present invention can contain organic or inorganic hardening agents. Examples of the hardening agents include chromates, aldehydes (e.g., formaldehyde and glutaraldehyde), N-methylol compounds (e.g., dimethylolurea), active vinyl compounds [e.g., 1,3,5-triacryloyl-hexahydro-s-triazine, bis(vinyl-sulfonyl)methyl ether, and N,N'-methylenebis(β-vinyl-sulfonyl)propionamide], active halogen compounds (e.g., 2,4-dichloro-6-hydroxy-s-triazine), mucohalogenic acids (e.g., mucochloric acid), N-carbamoylpyridinium salts [e.g., (1-morpholinocarbonyl-3-phridinio)methane-sulfonate], and haloamidinium salts [e.g., 1-(1-chloro-1-pyridinomethylene)pyrrolidinium 2-naphthalenesulfonate], and combinations thereof.

Preferred among these compounds are active vinyl compounds described in JP-A-53-41220, JP-A-53-57257, JP-A-59-162546 and JP-A-60-80846 and active halogen compounds described in U.S. Pat. No. 3,325,287.

The photographic emulsion used in this invention may be spectrally sensitized with methine dyes or others. Dyes used for spectral sensitization include cyanine dyes, merocyanine dyes, complex cyanine dyes, complex merocyanine dyes, holopolar cyanine dyes, hemicyanine dyes, styryl dyes, and himioxonol dyes, with cyanine dyes, merocyanine dyes and complex merocyanines dyes being particularly useful. Any of basic heterocyclic nuclei generally utilized in cyanine dyes can be applied to these dyes. Such basic heterocyclic nuclei include pyrroline, oxazoline, thiazoline, pyrrole, oxazole, thiazole, selenazole, imidazole, tetrazole, and pyridine nuclei; the above-described nuclei to which an alicyclic hydrocarbon ring is fused; and the above-described nuclei to which an aromatic hydrocarbon ring is fused, e.g., indolenine, benzidolenine, indole, benzoxazole, naphthoxazole, benzothiazole, naphthothiazole, benzoselenazole, benzimidazole, and quinoline nuclei. These nuclei may have substituents on the carbon atoms thereof.

Into the merocyanine dyes or complex merocyanine dyes can be introduced a 5- to 6-membered heterocyclic nucleus having a ketomethylene structure, e.g., phyrazolin-5-one, thiohydantoin, 2-thiooxazolidine-2,4-dione, thiazolidine-2,4-dione, rhodanine, and thiobarbituric acid nuclei.

The amount of these sensitizing dyes to be used preferably ranges from $1\times10^{-6}$ to $5\times10^{-3}$ mol per mol of silver.

The photographic emulsion according to the present invention may contain color image forming couplers, i.e., compounds capable of developing a color upon reaction with an oxidation product of an aromatic amine (usually primary amine) developing agent (hereinafter referred to as couplers). Couplers that are non-diffusible due to a hydrophobic group called a ballast group are preferred. The couplers may be either 2-equivalent or 4-equivalent to a silver ion. In addition to the color forming couplers, the photographic material may further contain colored couplers having a color correction effect or couplers capable off releasing a development inhibitor on development (so-called DIR couplers). The couplers may be those producing a colorless coupling reaction product.

Yellow-forming couplers include known open-chain ketomethylene couplers. Among them, benzoylacetanilides and pivaloylacetanilides are advantageous.

Magenta-forming couplers include pyrazolone couplers, indazolone couplers, and cyanoacetyl couplers, with pyrazolone couplers being particularly advantageous.

Cyan-forming couplers include naphthol couplers and phenol couplers.

A protective layer of the photographic material of the present invention comprises a hydrophilic colloid. Components of the hydrophilic colloid are those enumerated herein. The protective layer may be either single layered or multi-layered.

The emulsion layer or protective layer, preferably the protective layer, may contain a matting agent and/or a lubricating agent. Examples of suitable matting agents include organic compounds such as water-dispersible vinyl polymers, e.g., polymethyl methacrylate, and inorganic compounds such as silver halides and strontium barium sulfate, each having an appropriate particle size selected from a range of from 0.3 to 5 μm, or a particle size at least twice, preferably four times or more, the thickness of the protective layer. The lubricating agent serves to prevent blocking similarly to the matting agent and is particularly effective to improve friction characteristics relative to suitability for cameras or projectors in shooting or projection of motion picture films. Specific examples of useful lubricating agents are liquid paraffin; waxes, e.g., higher fatty acid esters; polyfluorohydrocarbons or derivatives thereof; and silicones, e.g., polyalkylpolysiloxanes, polyarylpolysiloxanes, polyalkylarylpolysiloxanes or alkylene oxide adducts thereof.

If desired, the photographic material of the present invention may further comprise an intermediate layer, a filter layer, and the like.

The present invention can be applied to X-ray light-sensitive materials, lith light-sensitive materials, black-and-white photographing light-sensitive materials, color negative light-sensitive materials, color reversal light-sensitive materials, color papers, and the like, preferably negative light-sensitive materials, more preferably black-and-white negative light-sensitive materials.

If desired, the photographic material of the invention can contain various photographic additives, including development accelerators, fluorescent brightening agents, color fog inhibitors, ultraviolet absorbents, and so on. Specific examples of these additives are described in *Research Disclosure*, No. 176, pp. 28-30 (RD-17643, 1978).

The support which can be used in the present invention typically includes a cellulose nitrate film, a cellulose acetate film, a polyvinyl acetal film, a polystyrene film, a polyethylene terephthalate film, or other polyester films, as well as glass, paper, metal, wood, etc.

With respect to development processing of the light-sensitive materials of the invention, reference can be made to it in the above-cited reference, RD-17643, pp. 28-30.

A fixer which can be used for fixation of the light-sensitive material according to the present invention includes FUJIFIX, SUPER FUJIFIX, FUJI DP FIX and SUPER FUJI FIX DP (each produced by Fuji Photo Film Co., Ltd.),.F-6 and KODAK Fixer (each produced by Eastman Kodak Co., Ltd.), KONIFIX and KONIFIX RAPID (each produced by Konishiroku Co., Ltd.), ORIFIX, MYFIX, NIWAFIX, NISSAN RAPID FIXER-F, NISSAN RAPID FIXER-P, PANFIX F, PANFIX P, MYROLL F, ORIENTAL QF, etc.

The present invention is now illustrated in greater detail with reference to the following Examples, but it should be understood that the present invention is not deemed to be limited thereto. Unless otherwise indicated, all parts, presents and ratios etc. are by weight.

EXAMPLE 1

(1) Preparation of Light-Sensitive Silver Halide Emulsion

Potassium bromide, potassium iodide, and silver nitrate were added to an aqueous gelatin solution while vigorously stirring to prepare a thick plate-like silver iodobromide emulsion (average iodine content: 6 mol %; mean grain size: 0.6 μm). The emulsion was washed with water according to a usual flocculation method and then subjected to gold-sulfur sensitization using chloroauric acid and sodium thiosulfate. The resulting emulsion was designated as Emulsion A.

(2) Preparation of Coated Sample

On a triacetyl cellulose support were coated the following layers so as to have a layer structure (A), (B) or (C) described below. The resulting light-sensitive material was designated as Sample 1, 2 and 3, respectively. Each of Samples 1 to 3 was obtained after continuous coating for 8 hours.

Layer Structure (A):

Surface protective layer/Emulsion layer/Support

Layer Structure (B):

Surface protective layer/Emulsion layer/Fixation accelerating layer/Support

Layer Structure (C):

Surface protective layer/Emulsion layer/Intermediate layer/Fixation accelerating layer/Support Each of the layers had the following composition.

| | |
|---|---|
| Fixation Accelerating Layer | |
| Binder (Gelatin-1) | 1 g/m² |
| Cationic polymer (Fixation accelerator) of formula: | 0.16 g/m² |

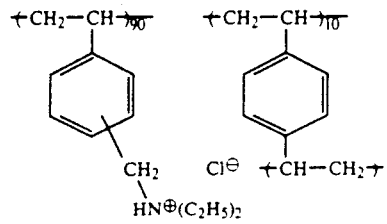

| | |
|---|---|
| Dye-8 | 25 mg/m² |
| Dye-27 | 15 mg/m² |
| Intermediate Layer | |
| Binder (Gelatin-1) | 0.4 g/m² |
| Coating aid [poly(potassium p-styrenesulfonate)] | 3.3 mg/m² |
| Emulsion Layer | |
| Emulsion A | 5.5 g-Ag/m² |
| Binder (Gelatin-2) | 1.6 g/g of Ag |
| Sensitizing dye of formula: | 2.1 mg/g of Ag |

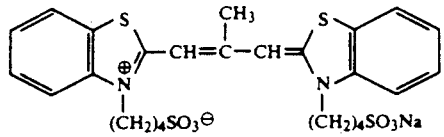

| | |
|---|---|
| Hardening agent [1,2-bis-vinylsulfonylacetamido)ethane] | 39 mg/m² |
| Additive ($C_{18}H_{35}O(CH_2CH_2O)_{20}H$) | 5.8 mg/g of Ag |
| Coating aid | |
| Sodium dodecylbenzenesulfonate | 0.1 mg/m² |
| Poly(potassium p-styrene-sulfonate | 220 mg/m² |
| Surface Protective Layer | |
| Binder (Gelatin-3) | 0.7 g/m² |
| Coating aid (sodium N-oleoyl-N-methyltaurine) | 0.2 mg/m² |
| Matting agent [polymethyl methacrylate fine particles (average particle size: 3 μm)] | 0.13 mg/m² |

The content of the high-molecular weight component in the gelatin used in the sample preparation was as follows.

| Gelatin | High-Molecular Weight Component Content* (wt %) |
|---|---|
| Gelatin-1 | 15.9 |

-continued

| Gelatin | High-Molecular Weight Component Content* (wt %) |
|---|---|
| Gelatin-2 | 4.1 |
| Gelatin-3 | 13.8 |

*The high-molecular weight component is the same definition as that of JP-A-62-87952

(3) Evaluation (a) Surface Property

Each of the thus obtained samples was evaluated for surface properties, particularly freedom from fine lines parallel to the coating direction, and rated as follows.

Good—No surface defects were observed.

Poor—Surface defects were observed, permitting no practical use.

The results are shown in Table 1 below.

(b) Fixing time

After preservation at 25° C. and 65% RH for 7 days, each of Samples 1 to 3 was developed with a developer having the following formulation at 20° C. for 7 minutes and then fixed in a fixer ("FUJIFIX" produced by Fuji Photo Film Co., Ltd.) for a varied fixing time. After drying, a transmittance of each sample was measured by means of a spectrophotomer, and the time required for reaching a transmittance of almost 100% was taken as a time for fixation completion. The results obtained are shown in Table 1 below

| Developer Formulation: | |
|---|---|
| Metol (p-Methylaminophenol sulfate) | 2 g |
| Sodium sulfite | 100 g |
| hydroquinone | 5 g |
| Borax decahydrate | 2 g |
| Water to make | 1 liter |

TABLE 1

| Sample No. | Layer Structure | Time for Fixation Completion (sec) | Surface Property | Remark |
|---|---|---|---|---|
| 1 | A | 70 | good | Comparison |
| 2 | B | 38 | poor | Comparison |
| 3 | C | 40 | good | Invention |

It can be seen from Table 1 that addition of an intermediate layer between an emulsion layer and a fixation accelerating layer (a cationic polymer-containing layer) as in sample 3 brings about an improvement in surface properties without impairing the fixation accelerating effect of the cationic polymer-containing layer.

EXAMPLE 2

(1) Preparation of Light-Sensitive Silver Halide Emulsion

A thick plate-like silver iodobromide emulsion (average iodine content : 10 mol %, mean grain size: 1.0 μm) was prepared in the same manner as in Example 1, except for properly adjusting the temperature for preparation and the amount of the potassium iodide. The resulting emulsion was designated as Emulsion B.

(2) Preparation of Coated Sample

The following layers were coated on a triacetyl cellulose support film according to a layer structure (D) or (E) as shown below. The resulting samples were designated as Samples 4 and 5, respectively. These samples were obtained after continuous coating for 8 hours.

Layer Structure (D):

Surface protective layer/Emulsion layer-1/Emulsion layer-2/Fixation accelerating layer/Undermost layer/-Support Layer Structure (E):

Surface protective layer/Emulsion layer-1/ Emulsion layer-2/Intermediate layer/Fixation accelerating layer/Undermost layer/Support Each of the layers had the following composition.

| | |
|---|---|
| Undermost Layer: | |
| Binder (Gelatin-1) | 1.6 g/m$^2$ |
| Coating aid [poly(potassium p-styrenesulfonate)] | 13.0 mg/m$^2$ |
| Fixation Accelerating Layer: | |
| The same as in Example 1. | |
| Intermediate Layer: | |
| The same as in Example 1 | |
| Emulsion Layer-1: | |
| Emulsion A (which was prepared in Example 1) | 1.5 g of Ag/m$^2$ |
| Binder (Gelatin-2) | 2 g/m$^2$ |
| Sensitizing dye (the same as in Example 1) | 2.1 mg/g-Ag |
| Additive | |
| ($C_{18}H_{35}O$-($CH_2CH_2$—O)$_{20}$—H) | 5.8 mg/g-Ag |
| Coating aids [poly(potassium p-styrenesulfonate] | 50 mg/m$^2$ |
| Hardening Agent [1,2-bis(vinylsulfonylacetamido)ethane] | 45 mg/m$^2$ |
| Emulsion Layer-2: | |
| Emulsion B | 4 g of Ag/m$^2$ |
| Binder (Gelatin-2) | 6.8 g/m$^2$ |
| Sensitizing dye (the same as in Example 1) | 2.1 mg/g-Ag |
| Additive: | |
| $C_{18}H_{35}O$-($CH_2CH_2$—O)$_2$—H | 5.8 mg/g/Ag |
| Trimethylolpropane | 420 mg/m$^2$ |
| Coating aid [poly(potassium p-styrenesulfonate] | 170 mg/m$^2$ |

Surface Protective Layer:

The same as in Example 1.

(3) Evaluation

Each of the samples was evaluated for surface property and rated in the same manner as in Example 1.

The samples were processed, and the time for fixation completion was determined in the same manner as in Example 1. The results obtained are shown in Table 2.

TABLE 2

| Sample No | Layer Structure | Time for Fixation Completion (sec) | Surface Property | Remark |
|---|---|---|---|---|
| 4 | D | 50 | poor | Comparison |
| 5 | E | 50 | good | Invention |

The results of Table 2 reveal that Sample 5 having an intermediate layer between a silver halide emulsion layer and a fixation accelerating layer exhibits improved surface properties without suffering from impairment of the fixation accelerating effect.

While the invention has been described in detail and with reference to specific embodiments thereof, it will be apparent to one skilled in the art that various changes and modifications can be made therein without departing from the spirit and scope thereof.

What is claimed is:

1. A silver halide photographic element which comprises a support having provided thereon at least one silver halide emulsion layer and at least one layer comprising a polymer containing a group which can be dissociated to form a cation in a fixer and a dye, said photographic element having a total iodide content at AgI of at least $4—10^{-3}$ mol/m$^2$, wherein a layer consisting essentially of hydrophilic colloid binders and having a film thickness of 1 μm or less is present between said layer comprising said polymer and said silver halide emulsion layer, said layer comprising the polymer, the layer consisting essentially of hydrophilic colloid binders and the silver halide emulsion layer are each on the same side of the support, wherein said polymer is an anion exchange polymer represented by formula (I):

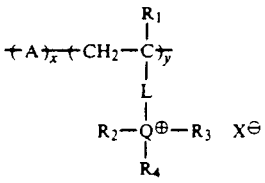

(I)

wherein A represents an ethylenically unsaturated monomer unit; $R_1$ represents a hydrogen atom or a lower alkyl group having from 1 to about 6 carbon atoms; L represents a divalent group containing from 1 to about 12 carbon atoms; $R_2$, $R_3$, and $R_4$, which may be the same or different, each represents an alkyl group having from 1 to about 20 carbon atoms, an aralkyl group having from 7 to about 20 carbon atoms, or a hydrogen atom; or $R_2$, $R_3$, and $R_4$ are connected to each other to form a cyclic structure together with Q; Q represents N or P; X represents an anion other than an iodine ion; X represents a copolymerization ratio ranging from 0 mol % to about 90 mol %; and y represents a copolymerization ratio ranging from about 10 mol % to about 100 mol %, and wherein said polymer is present in an amount of at least 0.1 mol, in terms of the group which can be dissociated in a fixer, per mol of total iodine content in the photographic element.

2. A silver halide photographic element as claimed in claim 1, wherein $R_1$ represents a hydrogen atom or a methyl group.

3. A silver halide photographic element as claimed in claim 1, wherein only one of $R_2$, $R_3$, and $R_4$ represents a hydrogen atom.

4. A silver halide photographic element as claimed in claim 1, wherein L represents -C-O-$R_5$-,

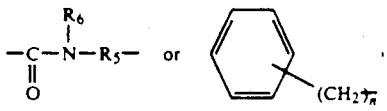

wherein $R_5$ represents an alkylene group, an arylene group or an aralkylene group; $R_6$ represents a hydrogen atom or $R_2$; and n represents 1 or 2.

5. A silver halide photographic element as claimed in claim 4, wherein L represents

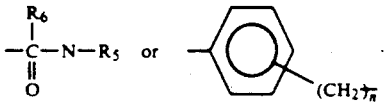

6. A silver halide photographic element as claimed in claim 4, wherein L represents

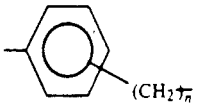

7. A silver halide photographic element as claimed in claim 1, wherein Q represents N.

8. A silver halide photographic element as claimed in claim 1, wherein X- represents a chlorine ion, an alkylsulfate ion, an arylsulfonate ion or a sulfate ion.

9. A silver halide photographic element as claimed in claim 1, wherein the alkyl group as represented by $R_2$, $R_3$ or $R_4$ contains from 1 to 12 carbon atoms, and the aralkyl group as represented by $R_2$, $R_3$ or $R_4$ contains from 7 to 14 carbon atoms.

10. A silver halide photographic element as claimed in claim 1, wherein said cyclic structure formed by $R_2$, $R_3$, $R_4$, and Q is represented by the formula:

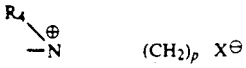

wherein p represents an integer of from 4 to 6, or the formula

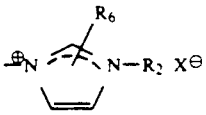

wherein $R_6$ represents a hydrogen atom or $R_2$.

11. A silver halide photographic element as claimed in claim 1, wherein x is from 20 to 60 mol %, and y is from 40 to 80 mol %.

12. A silver halide photographic element which comprises a support having provided thereon at least one silver halide emulsion layer and at least one layer comprising a polymer containing a group which can be dissociated to form a cation in a fixer and a dye, said photographic element having a total iodide content at AgI of at least $4—10^{-3}$ mol/m$^2$, wherein a layer consisting essentially of hydrophilic colloid binders and having a film thickness of 1 μm or less is present between said layer comprising said polymer and said silver halide emulsion layer, said layer comprising the polymer, the layer consisting essentially of hydrophilic colloid binders and the silver halide emulsion layer are each on the same side of the support, wherein said polymer is an anion exchange polymer represented by formula (II):

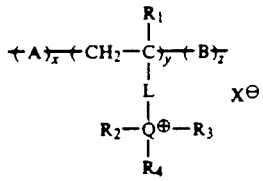

(II)

wherein A represents an ethylenically unsaturated monomer unit; $R_1$ represents a hydrogen atom or a lower alkyl group having from 1 to about 6 carbon atoms; L represents a divalent group containing from 1 to about 12 carbon atoms; $R_2$, $R_3$, and $R_4$, which may be the same or different, each represents an alkyl group having from 7 to about 20 carbon atoms, an aralkyl group having from 7 to about 20 carbon atoms, or a hydrogen atom; or $R_2$, $R_3$, and $R_4$ are connected to each other to form a cyclic structure together with Q; Q represents N or P; X represents an anion other than an iodine ion; B represents a monomer unit derived from a copolymerizable monomer having at least two ethylenically unsaturated groups; X represents a copolymerization ratio ranging from 0 mol % to about 80 mol %; y represents a copolymerization ratio ranging from about 10 mol % to about 99.9 mol %, and z represents a copolymerization ratio ranging from 0.1 to 50 mol %, and wherein said polymer is present in an amount of at least 0.1 mol, in terms of the group which can be dissociated in a fixer, per mol of total iodine content in the photographic element.

13. A silver halide photographic element as claimed in claim 12, wherein the monomer unit represented by B is a unit derived from divinylbenzene or trivinylcyclohexane.

14. A silver halide photographic element as claimed in claim 1, wherein said layer comprising said polymer is a light-insensitive layer provided between a light-sensitive layer and the support.

15. A silver halide photographic element as claimed in claim 1, wherein the layer consisting essentially of hydrophilic colloid binders has a film thickness of 0.6 μm or less.

* * * * *